United States Patent [19]

Nakagawa et al.

[11] 4,430,529

[45] Feb. 7, 1984

[54] PIEZOELECTRIC LOUDSPEAKER

[75] Inventors: Nobuhiko Nakagawa; Tsutomu Yoshii, both of Ishikawa, Japan

[73] Assignee: Murata Manufacturing Co., Ltd., Japan

[21] Appl. No.: 331,586

[22] Filed: Dec. 17, 1981

[30] Foreign Application Priority Data

Dec. 24, 1980 [JP] Japan ..... 55-184898
Feb. 2, 1981 [JP] Japan ..... 56-14862

[51] Int. Cl.[3] ..... H04R 17/00
[52] U.S. Cl. ..... 179/110 A; 310/326
[58] Field of Search ..... 179/110 A, 178, 181 R; 181/164, 165, 166; 310/326, 351, 352

[56] References Cited

U.S. PATENT DOCUMENTS 2,810,082 10/1957 Tibbetts ..... 179/180
3,584,245 6/1971 Helfen ..... 310/352
3,761,956 9/1973 Takahashi ..... 179/110 A
3,786,202 1/1974 Schafft ..... 181/166
4,012,604 3/1977 Speidel ..... 310/326
4,283,605 8/1981 Nakajima ..... 179/110 A
4,292,561 9/1981 Martin ..... 179/110 A

*Primary Examiner*—G. Z. Rubinson
*Assistant Examiner*—L. Schroeder
*Attorney, Agent, or Firm*—Ostrolenk, Faber, Gerb & Soffen

[57] ABSTRACT

A piezoelectric loudspeaker having a bending mode piezoelectric diaphragm mounted on a diaphragm stretched across a frame, the piezoelectric diaphragm being supported at its central portion to a support provided at the frame, so that the central portion of piezoelectric diaphragm is stationary free from vibrations, thereby being higher in a sound pressure level and smaller in acoustic distortion than the conventional loudspeaker.

13 Claims, 9 Drawing Figures

PIEZOELECTRIC LOUDSPEAKER

BACKGROUND OF THE INVENTION

This invention relates to a piezoelectric loudspeaker which is small in thickness and generates a sound by means of vibrations of a piezoelectric diaphragm.

A moving-coil loudspeaker now widely used restricts various acoustic instruments from being small-sized or small in thickness. The possibility of a thin piezoelectric loudspeaker has recently attracted the public attention.

The thin piezoelectric loudspeaker, as shown in FIG. 1, comprises a diaphragm 2 stretched across a frame 1 and a piezoelectric diaphragm 3 of a bending mode type which is stuck at the central portion of diaphragm 2, the piezoelectric diaphragm 3 comprising a piezoelectric ceramic plate stuck onto a metallic plate. Such piezoelectric loudspeaker has a thin diaphragm 2 and also a thin piezoelectric diaphragm 3, thereby making it possible to generate a sound even in the low frequency band side of audio frequency region.

The piezoelectric loudspeaker having the foregoing construction however, is still insufficient for the sound pressure level and acoustic distortion in comparison with the moving-coil loudspeaker widely used.

After various experiments in order to solve the above problem, we have found that the above piezoelectric loudspeaker, as shown in FIG. 2, is irregular in its bending mode type. As seen from the actual vibration mode shown in FIG. 2, whole the diaphragm 2 and the piezoelectric diaphragm 3 are not vibrated as a single unit. Rather, the peripheral edges (shown as A,B) of the piezoelectric diaphragm 3 are vibrated vertically, resulting in that air is simultaneously pushed out and taken in.

For example, when the peripheral portion of piezoelectric diaphragm 3 is bent downwardly in FIG. 2, air is pushed out at area $\alpha$ shown by oblique line and taken in at area $\beta$ shown by oblique line done so, whereby pushing out and taking in of the air interfere mutually so as to cause a low sound pressure level. Also differences in volume of an input signal change the vertical movement of fulca A and B resulting in degree of interference, thereby causing the acoustic distortion.

Thus, the conventional piezoelectric loudspeaker is low in the sound pressure level and larger in the acoustic distortion, which is inferior in performance and hinders practical use.

OBJECTS OF THE INVENTION

In the light of the above problem, this invention has been designed. This invention is directed to keeping stationary the central portion of the piezoelectric diaphragm of the conventional piezoelectric loudspeaker to thereby raise the sound pressure level and reduce the acoustic direction.

An object of the invention is to provide a piezoelectric loudspeaker which is high in the sound pressure level, smaller in the acoustic distortion, and suitable for practical use.

BRIEF DESCRIPTION OF THE DRAWINGS

The above and further objects and novel features of the invention will be more apparent from a reading of the following description of the disclosure found in the accompanying drawings.

DETAILED DESCRIPTION OF THE PREFERRED EMBODIMENTS

Figure 1:
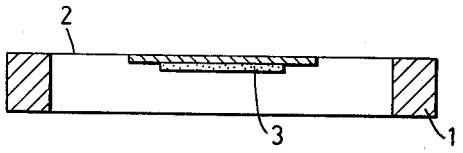
FIG. 1 is a sectional view of a conventional piezoelectric loudspeaker.
Figure 2:
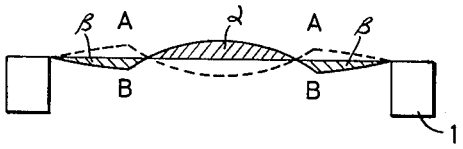
FIG. 2 is a view explanatory of the vibration mode of a diaphragm of the piezoelectric loudspeaker in FIG. 1.
Figure 3:
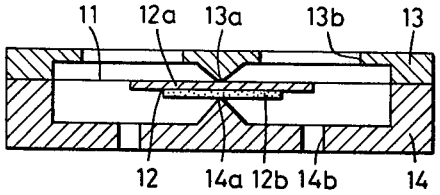
FIG. 3 is a sectional view of a first embodiment of a piezoelectric loudspeaker of the invention.

Referring to FIG. 3, in the first embodiment of a piezoelectric loudspeaker of the invention, a piezoelectric diaphragm 12 of a bending mode type is adhered onto a diaphragm 11 with an adhesive or the like, the diaphragm 11 being tensioned and sandwiched between a pair of frames 13 and 14. The piezoelectric diaphragm comprises a metallic disc 12*a* made of brass or the like and a disc-shaped piezoelectric ceramic plate 12*b* or piezoelectric ceramic material such as PZT adhered concentrically onto the plate 12*a* by use of an adhesive or the like. The frame 13 at the sound radiation side comprises a bottomed cylindrical member and is provided at the central portion of the bottom with a tapered support protuberance 13*a*, and at the portion except for the central portion with a plurality of sound radiating bores relatively large-sized. The frame 14 comprises a bottomed cylindrical member and is provided at the central portion of the bottom with a tapered support protuberance 14*a*, and with a plurality of small bores 14*b* surrounding the protuberance 14*a*, so that the support protuberances 13*a* and 14*a* sandwich therebetween the piezoelectric diaphragm 12 including the diaphragm 11, at the center thereof, thereby keeping stationary the central portion of piezoelectric diaphragm 12, amplitude becoming maximum when the central portion is not kept.

Figure 4:
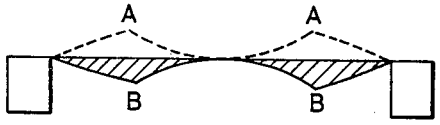
FIG. 4 is a view explanatory of the vibration mode of a diaphragm in the FIG. 3 embodiment.

The diaphragm of the piezoelectric loudspeaker constructed as the above, vibrates in a vibration mode as shown in FIG. 4, in which the diaphragm 11 is supported at the center and outer periphery thereof, so that the piezoelectric diaphragm 12 and diaphragm 11 vibrate between the centers and the outer peripheries, respectively. For example, when the piezoelectric diaphragm 12 bends at its periphery downwardly in the drawing, an area shown by oblique lines does not push out air but only takes in it. When the piezoelectric diaphragm 12 reversely bends, air is pushed out only. Therefore, vibrational energy of piezoelectric diaphragm 12 is transformed to acoustic waves without so much loss, thereby raising the sound pressure level. Also, the piezoelectric diaphragm 12 vibrates at the fulcra A and B regularly vertically to thereby reduce the acoustic distortion. Furthermore, the piezoelectric diaphragm 12, which is stationary at the central portion, restrains the resonance peak particular to the piezoelectric effect to thereby obtain a flatter frequency characteristic.

In the first embodiment, the piezoelectric diaphragm 12 should be supported at its center in consideration of a material or shape of the supports to thereby avoid the occurrence of resonance of support therein and transfer through the support of vibrational energy. Also, it is necessary for the diaphragm 11 to be small in thickness so that less vibrational energy is transmitted to the frames 13 and 14. By taking the above matter in full consideration, more vibrational energy can be contained in the piezoelectric diaphragm 12 and diaphragm 11, resulting in that the sound pressure level can be maximally raised.

Also, one or both support protuberances may be screw-threaded to adjust the intensity of supporting the piezoelectric diaphragm 12 (including the diaphragm 11) by the support protuberances (adjustment of a stationary condition), thereby enabling adjustment of the frequency characteristic of the loudspeaker.

Figure 5:
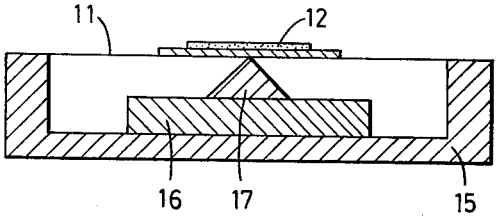
FIG. 5 is a sectional view of a second embodiment of the invention.

Next, the second embodiment in FIG. 5 will be detailed.

In this embodiment, a holder 16 of large mass is mounted on the inner surface of the bottom of a bottomed cylindrical frame 15, and a tapered support 17 is mounted on the holder 16 so that the tip of support 17 is positioned substantially at the center of an opening of frame 15. A diaphragm 11 stretched across said opening and a bending mode type piezoelectric diaphragm 12 is stuck to the center of diaphragm 11 by an adhesive or the like. The central portion of diaphragm 11 is fixed substantially at a point to the tip of support 17 by the adhesive, thereby being kept stationary. The vibration mode, function, and effect, of the second embodiment are approximately similar to those in the first embodiment, thereby being omitted of details herewith. There is only a difference between the first and second embodiments, in that the holder 16 of large mass can effectively prevent transfer of vibrational energy to the frame 15.

In addition, in the second embodiment, the diaphragm 11 interposed between the support 17 and the piezoelectric diaphragm 12, allows the vibrational energy to escape through the diaphragm 11, which will almost be remedied by mounting the piezoelectric diaphragm 12 on the diaphragm 11 at a side of the bottom of frame 15 and by supporting the piezoelectric diaphragm 12 directly with the support 17. Alternatively, the piezoelectric diaphragm 12 may be supported directly by the support 17 through an orifice provided at the contact portion of diaphragm 11. Such support means also is applicable to the first embodiment in FIG. 3.

Figure 6:
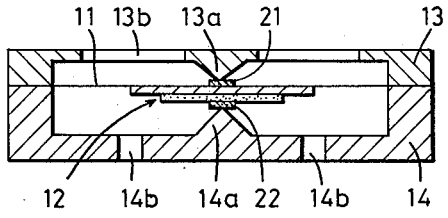
FIG. 6 is a sectional view of a third embodiment of the invention.

Next, a third embodiment in FIG. 6 will be detailed.

This embodiment aims at reliably keeping tensioned or stationary the central portion of the aforesaid piezoelectric diaphragm 12, the means being cramp, sticking and pressurization, thereby preventing generation of noise caused by a shift of the central stationary point and enabling massproduction of the loudspeakers.

In detail, a bending mode type piezoelectric diaphragm 12 is stuck onto the center of a diaphragm 11 by an adhesive or the like and elastic bodies 21 and 22 are stuck onto the upper surface of diaphragm 11 and the lower surface of the piezoelectric ceramic plate at the central portions thereof respectively, the diaphragm 11 being tensioned and sandwiched between the pair of frames 13 and 14. The frame 13 at the sound radiation side comprises a bottomed cylindrical member and has at the center of the bottom a tapered support protuberance 13*a* and at the portion except for the central portion a sound radiating bore 13*b* relatively larger. The frame 14 also comprises a bottomed cylindrical member and has a tapered support protuberance 14*a* at the central portion of the bottom and a plurality of small bores 14*b* surrounding the protuberance 14*a*, the protuberances 13*a* and 14*a* sandwiching therebetween under pressure the central portions of diaphragm 11 and piezoelectric diaphragm 12 through the elastic bodies 21 and 22, thereby keeping stationary the central portion of piezoelectric diaphragm 12 where the maximum amplitude occurs.

Furthermore, the vibration mode of loudspeaker in the third embodiment is the same as in FIG. 4. Hence, the vibrational energy, similarly to the first embodiment, can be transformed to acoustic waves without so much loss to thereby raise the sound pressure level, reduce the acoustic distortion, and obtain a further flat frequency characteristic. Furthermore, even when the positions cramp or stationary kept by the support protuberances 13*a* and 14*a*, shift from the center of piezoelectric diaphragm 12, the interposed elastic bodies 21 and 22 can prevent generation of noise.

Alternatively, the elastic bodies 21 and 22 in the third embodiment may not be stuck but be inserted merely between the diaphragm 11 and the support protuberance 13*a* and between the piezoelectric diaphragm 12 and the protuberance 14*a*. Or, one or both support protuberances 13*a* and 14*a* are screw-threaded to adjust the intensity of holding the piezoelectric diaphragm 12 (inclusive of diaphragm 11), in other words, to adjust the stationary condition, thereby enabling the adjustment of frequency characteristic of the loudspeaker.

Figure 7:
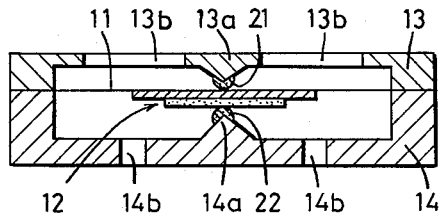
FIG. 7 is a sectional view of a fourth embodiment of the invention.

Referring to FIG. 7, a fourth embodiment of the invention is shown, in which the elastic bodies are different in construction from the third embodiment.

Namely, elastic bodies 21 and 22 are formed of elastic material coated on the tips of support protuberances 13*a* and 14*a*, and sandwich under pressure the central portions of the diaphragm 11 and piezoelectric diaphragm 12.

Figure 8:
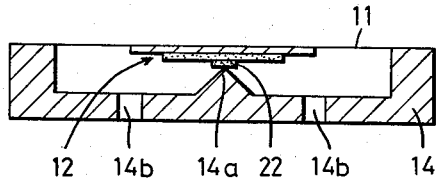
FIG. 8 is a sectional view of a fifth embodiment of the invention.

In a fifth embodiment in FIG. 8, the piezoelectric diaphragm 12 is kept stuck by adhesive or pressurized by protuberance 14*a* at its central portion only from one side, which corresponds to the embodiment in FIG. 6 from which the frame 13 and elastic body 21 are omitted, where the diaphragm 11 is fixed to the edge of frame 14.

Figure 9:
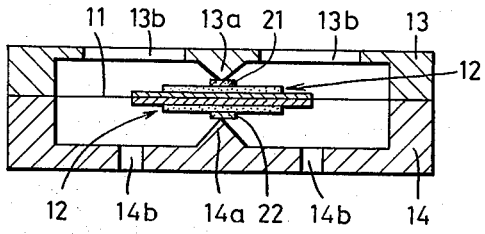
FIG. 9 is a sectional view of a sixth embodiment of the invention.

A sixth embodiment in FIG. 9 provides two piezoelectric diaphragms 12 at both sides of diaphragm 11, elastic bodies 21 and 22 being stuck onto the central portions of piezoelectric diaphragms 12 respectively. In addition, the vibration mode, function, and effect, of the respective fourth, fifth and sixth embodiment are the same as those in the first embodiment and omitted of description.

Also, the support protuberances 13*a* and 14*a* and support 17, which are triangular in section, may alternatively be hemispherical. Alternatively, the piezoelectric diaphragm 12 may comprise a piezoelectric ceramic plate fixed to an insulating plate, or two piezoelectric ceramic plates stuck to each other. In brief, these are enough to perform flexion vibrations by themselves.

As seen from the above, the loudspeaker of the invention keeps stationary the central portion of the bending mode type piezoelectric diaphragm mounted on the main diaphragm, so that, in comparison with the conventional piezoelectric loudspeaker, the sound pressure level is high, the acoustic distortion is small, and noise generation caused by shift of the cramp or stationary central portion can be prevented.

Although several embodiments have been described, they are merely exemplary of the invention and not to be constructed as limiting, the invention being defined solely by the appended claims.

What is claimed is:

1. A piezoelectric loudspeaker, comprising:

a frame;

a flexible diaphragm stretched across said frame, said frame supporting said flexible diaphragm along a substantially continuous line defining an outer perimeter along which said flexible diaphragm is kept stationary and free from vibrations;

a bending mode type piezoelectric diaphragm adhered to said flexible diaphragm at a location inside said outer perimeter; and means for keeping a central portion of said piezoelectric diaphragm stationary and free from vibrations.

2. A piezoelectric loudspeaker according to claim 1, wherein said piezoelectric diaphragm has first and second main opposing surfaces and wherein the entire said first main surface is adhered to said flexible diaphragm.

3. A piezoelectric loudspeaker according to claim 2, wherein the outer perimeter of said piezoelectric diaphragm falls within said outer perimeter defined by said substantially continuous line.

4. A piezoelectric loudspeaker according to claim 1, wherein said means comprises a protuberance connected to said frame and in contact with said central portion of said piezoelectric diaphragm.

5. A piezoelectric loudspeaker according to claim 4, wherein said thin diaphragm is adhered to said protuberance.

6. A piezoelectric loudspeaker according to claim 4, wherein said piezoelectic diaphragm is adhered to said protuberance.

7. A piezoelectric loudspeaker according to claim 1, wherein said frame includes upper and lower portions and wherein said means comprises a pair of tapered support protuberances connected to said upper and lower portions, respectively, of said frame, said central portion of said piezoelectric diaphragm being sandwiched between said support protuberances.

8. A piezoelectric loudspeaker according to claim 1, wherein said means comprises a tapered support provided on a holder mounted on the bottom of said frame, said flexible diaphragm being adhered to said tip so that the central portion of said piezoelectric diaphragm is kept stationary and free from vibrations.

9. A piezoelectric loudspeaker according to claim 1, wherein said flexible diaphragm is provided at the center with an orifice through which the tip of a support directly carries said piezoelectric diaphragm, said means including said support.

10. A piezoelectric loudspeaker according to claim 1, wherein said means comprises electric bodies which sandwich the central portion of said piezoelectric diaphragm.

11. A piezoelectric loudspeaker according to claim 10, said frame includes upper and lower portions and wherein said means comprises first and second said elastic bodies which are adhered or coated onto first and second tapered protuberances, respectively, said protuberances being provided at said upper and lower portions, respectively, of said frame.

12. A piezoelectric loudspeaker according to claim 10, wherein one of said elastic bodies is adhered or coated onto the tip of said support protuberances provided at said frame and keeps said diaphragm tensioned from one side thereof.

13. A piezoelectric loudspeaker according to claim 1, wherein a respective piezoelectric diaphragm is adhered to each of two opposite sides of said flexible diaphragm.

* * * * *